US011648446B2

(12) United States Patent
Bom

(10) Patent No.: US 11,648,446 B2
(45) Date of Patent: May 16, 2023

(54) GOLF BAG

(71) Applicant: Bordeso B.V., Leusden (NL)

(72) Inventor: Petrus Leonardus Jozef Bom, Leusden (NL)

(73) Assignee: Bordeso B. V., Leusden (NL)

( * ) Notice: Subject to any disclaimer, the term of this patent is extended or adjusted under 35 U.S.C. 154(b) by 943 days.

(21) Appl. No.: 16/325,924

(22) PCT Filed: Aug. 23, 2017

(86) PCT No.: PCT/NL2017/050551

§ 371 (c)(1),
(2) Date: Feb. 15, 2019

(87) PCT Pub. No.: WO2018/038607

PCT Pub. Date: Mar. 1, 2018

(65) Prior Publication Data

US 2021/0308540 A1 Oct. 7, 2021

(30) Foreign Application Priority Data

Aug. 23, 2016 (NL) ..... 2017354

(51) Int. Cl.
*A63B 55/40* (2015.01)
*A63B 55/50* (2015.01)
*A63B 55/00* (2015.01)

(52) U.S. Cl.
CPC ..... *A63B 55/40* (2015.10); *A63B 55/50* (2015.10); *A63B 55/404* (2015.10)

(58) Field of Classification Search
CPC ..... A63B 55/40; A63B 55/50; A63B 55/404
See application file for complete search history.

(56) References Cited

U.S. PATENT DOCUMENTS 2,023,792 A * 12/1935 Sampson ..... A63B 55/40 206/315.6
2,283,412 A 5/1942 Bright
4,834,235 A 5/1989 Solheim
5,415,284 A * 5/1995 King ..... A63B 55/40 280/DIG. 6
5,469,960 A * 11/1995 Yuill ..... A63B 55/40 206/315.6
9,694,264 B2 * 7/2017 Bom ..... A63B 55/40
(Continued)

FOREIGN PATENT DOCUMENTS

WO WO 1992/005842 4/1992
WO WO 2015/020521 2/2015

OTHER PUBLICATIONS

International Search Report dated Feb. 20, 2018 from PCT/NL2017/050551.

(Continued)

*Primary Examiner* — Derek J Battisti
(74) *Attorney, Agent, or Firm* — Adsero IP

(57) ABSTRACT

Golf bag, comprising a club holder, provided with supporting legs, for receiving golf clubs. The golf bag is adjustable between a collapsed position in which the supporting legs extend substantially along the club holder, and a folded-out position in which the supporting legs extend away from the club holder and support the club holder in an inclined position. The club holder comprises a flexible pouch for therein receiving golf clubs by the shaft thereof.

15 Claims, 10 Drawing Sheets

(56) References Cited

U.S. PATENT DOCUMENTS

| | | | | |
|---|---|---|---|---|
| 2007/0164525 | A1* | 7/2007 | Rodrigues | A63B 71/0036 280/47.18 |
| 2013/0105341 | A1* | 5/2013 | Whitworth | A63B 55/408 206/315.6 |
| 2017/0095712 | A1* | 4/2017 | Johnston | A63B 55/10 |
| 2020/0215400 | A1* | 7/2020 | Martell | A45C 7/0077 |

OTHER PUBLICATIONS

Intention to Grant for EU17762228.9 dated Mar. 26, 2020, 31 pages.

* cited by examiner

GOLF BAG

RELATED APPLICATIONS

This application is a 35 U.S.C. § 371 national phase application of PCT/NL2017/050551 (WO 2018/038607), filed on Aug. 23, 2017, entitled "Golf Bag", which application claims priority to Netherlands Application No. 2017354, filed Aug. 23, 2016, which is incorporated herein by reference in its entirety.

The invention relates to a golf bag.

Golf bags are generally known and are intended to accommodate a set of golf clubs, for instance during storage, transport and play.

A golf bag must be able to accommodate the clubs, which often differ strongly mutually in shaft length and head shape, in a conveniently arranged manner. A standard set of golf clubs comprises, for instance, as many as 14 clubs, for instance one or more fairway woods, drivers, putters, irons, and a sand wedge. A set of golf clubs can easily weigh some 10 kilograms, and is often relatively costly.

A golf bag must not only accommodate the set of clubs in a conveniently arranged manner, but also provide proper protection and be light of weight at the same time. Also, the golf bag must be easy to handle, and take up little space during transport.

Known golf bags comprise a club holder, provided with supporting legs, for receiving golf clubs, which golf bag is adjustable between a collapsed position in which the supporting legs extend substantially along the club holder, and a folded-out position in which the supporting legs extend away from the club holder and support the club holder in an inclined position.

The classic golf bag—where the club holder is a large, stiff tube provided with a shoulder strap—poorly meets the above-mentioned criteria, and has been the point of departure for a variety of innovation attempts. In particular, a design has been sought that is lightweight, that protects the golf clubs well, that is compact and well manageable during transport, and that can present the set of golf clubs in a conveniently arranged manner.

In practice, it has proved difficult to meet the above-mentioned criteria at the same time to a sufficient extent.

In applicant's NL 2011271, a golf bag is provided where the club holder comprises a front panel and a back panel having therebetween a bundle of shaft receptacles for therein receiving a golf club by the shaft thereof. Front and back panel are connected with each other at a bottom of the golf bag, and are adjustable relative to each other between a collapsed, substantially flat position in which front and back panel run substantially along each other, and a folded-out, substantially wedge-shaped position in which front and back panel diverge and in which between their free ends a presentation plane is located in which the shaft receptacles terminate. With mutual spacing, the shaft receptacles are grouped in rows which run along each other with an intermediate distance, so that golf clubs whose shaft is received in a shaft receptacle have their heads positioned on the presentation plane in rows spaced apart with an intermediate distance.

While this golf bag already provides many advantages, the need existed to improve it still further in the area of weight, compactness, convenience of use, and production costs. The object of the invention is to provide a golf bag having a further improved design, and that is still more satisfactory on at least a number of the points mentioned, in particular, having a design that is lightweight, that protects the golf clubs well, that is compact and well manageable during transport, that can present the set of golf clubs during golf play in a conveniently arranged manner, and that can be manufactured more cost-effectively.

To this end, the invention provides a golf bag, comprising a club holder, provided with supporting legs, for receiving golf clubs, which golf bag is adjustable between a collapsed position in which the supporting legs extend substantially along the club holder, and a folded-out position in which the supporting legs extend away from the club holder and support the club holder in an inclined position, wherein the club holder comprises a flexible pouch for therein receiving golf clubs by the shaft thereof.

By providing the club holder with a flexible pouch for therein receiving golf clubs by the shaft thereof, for at least a part of the club holder, use can be made of a thin, flexible material such as fabric or foil (film), so that the weight can be further lowered, the dimensions can be further reduced, and the manufacturing cost can be lower. The pouch can be flat in the collapsed position because of its flexibility, and—possibly helped by the weight of the golf clubs received in the pouch—can hang out under the influence of, for example, gravity.

Compactness can be further augmented when the pouch in the collapsed position is constricted. Constriction can be carried out with the aid of a constricting provision. The constricting provision may for instance comprise a pull element, such as a cord, an elastic portion and/or a zipper. Alternatively or additionally, the constricting provision may also be augmented by an envelope, which, in a closed position thereof in the collapsed position snugly envelops the pouch and prevents the pouch from hanging out, and which in a release position releases the pouch for it to hang out. An example is, for instance, an outer jacket provided with a zipper, which in the closed position tightly envelops the pouch or even the whole club holder, and which after unzipping releases the pouch for it to hang out.

When the supporting legs in the opened position set up a top of the flexible pouch in a presentation plane, it can be achieved that the pouch in the folded-out position is well accessible for inserting and removing the golf clubs.

When in the presentation plane shaft receptacles terminate, which with a mutual spacing are grouped in rows which run along each other with an intermediate distance, it can be achieved that golf clubs whose shaft is received in a shaft receptacle have their heads positioned on the presentation plane in a conveniently arranged manner in rows spaced apart with an intermediate distance. Shaft receptacles can facilitate insertion and removal of the golf clubs, because they guide the shaft. Also, they help to keep the clubs in place, so that these can be presented in a conveniently arranged manner in the folded out position, and can be stored compactly in the collapsed position. The shaft receptacles are advantageously implemented as compartments of a flexible, sack-shaped part which forms the pouch.

By providing a front panel and a back panel having therebetween a bundle of shaft receptacles, a construction can be provided that can be made of sturdy and lightweight design, while yet providing good protection.

When the club holder comprises a substantially stiff back part, and a flexible, sack-shaped part connected therewith, a very compact and cost effective construction can be achieved. The sack-shaped part can then itself constitute the pouch, and may then be implemented, for example, as a flexible, tube-shaped sack. However, the sack-shaped part may also constitute the pouch together with the back part, and may then be implemented, for example, as a belly part extending along the back part.

When the sack-shaped part in the collapsed position is fixedly constricted onto the back part, the constriction in the collapsed position can be secured, and compactness enhanced. The sack-shaped part may for instance be fixedly constricted onto the stiff back part with the aid of a pull element, such as a cord.

When the sack-shaped part in the folded-out position hangs from the back part, fanning out, it can be achieved that in the folded-out position the pouch, at a top of the golf bag, has a relatively large and well accessible presentation plane for the golf clubs. The pouch then forms, for instance, a tube narrowing down from a wide top, in particular a conical or wedge-shaped tube. Alternatively, however, the pouch may also form a cylindrical or block-shaped tube in the folded-out position. Fanning out can take place during folding out as a result of the force of gravity exerted on the golf clubs.

When the back part forms a supporting face, the golf bag in the collapsed position can be very compact, and the golf clubs can be well protected at the same time. The supporting face may then be formed as a substantially flat face, but may also be at least partly trough-shaped. The supporting face may for instance be built up from plates which may or may not be perforated, or, for instance, profiles or tubes extending in mutually spaced relation, with spacers and/or web material, such as fabric, between them.

The sack-shaped part can form a flexible front panel of the golf bag, and possibly can also form at least a part of side panels of the golf bag. Side panels of the golf bag may be stiff or flexible, or mixed, for example, stiff adjacent the top for protection of the heads of golf clubs and flexible at the bottom to enhance compactness. The back part can form a stiff back panel and the front panel may then be, for instance, due to its flexibility, pivotably connected at the bottom of the back part.

By providing a pull element with which the golf bag is adjustable from the folded-out position, to the collapsed position, the golf bag can be simply returned from the folded-out position to the collapsed position.

By coupling the pull element with a shoulder strap attached to the bag, the golf bag can during lifting be returned, against gravity, to the collapsed position. Preferably, the golf bag can fold out during setting down under the weight of the golf clubs.

By coupling the pull element with a free edge of the pouch, the pull element can support the pouch in the folded-out position, and constrict it in the collapsed position.

By coupling the pull element with the supporting legs, these can be brought into the collapsed position with the pull element, for instance against a bias that energizes the supporting legs towards the folded-out position.

Thus, the golf bag can automatically fold out upon being set down, and automatically collapse upon being lifted. By providing the back part at a top thereof with a handle, lifting and collapsing can be facilitated.

When the supporting legs in folded-out position keep the pouch opening open at a free edge of the pouch, insertion of the golf clubs can be facilitated. Elegantly, the supporting legs are then pivotably arranged at a top of the back part, and in the collapsed position extend along the back part with their free ends directed to the bottom of the golf bag, while in the folded-out position they run away from the back part and are located at a distance from the bottom of the back part.

The supporting legs may possibly be further provided with hinges, with which the supporting legs, in a variant of the folded-out position, can be brought in a configuration with their free ends near the bottom of the back part. In this variant, for instance, the golf bag can be coupled in folded-out condition with a buggy or golf cart without the supporting legs being in the way.

It is noted that the technical features of the golf bag described in the paragraphs above may each also be advantageously used per se in a golf bag with a different configuration, i.e., the individual technical features may, if desired, be isolated from their context and be used alone, and, if desired, be combined with one or more of the above-mentioned features.

The invention will be further elucidated on the basis of an exemplary embodiment which is represented in a drawing. In the drawing.

Figure 1:
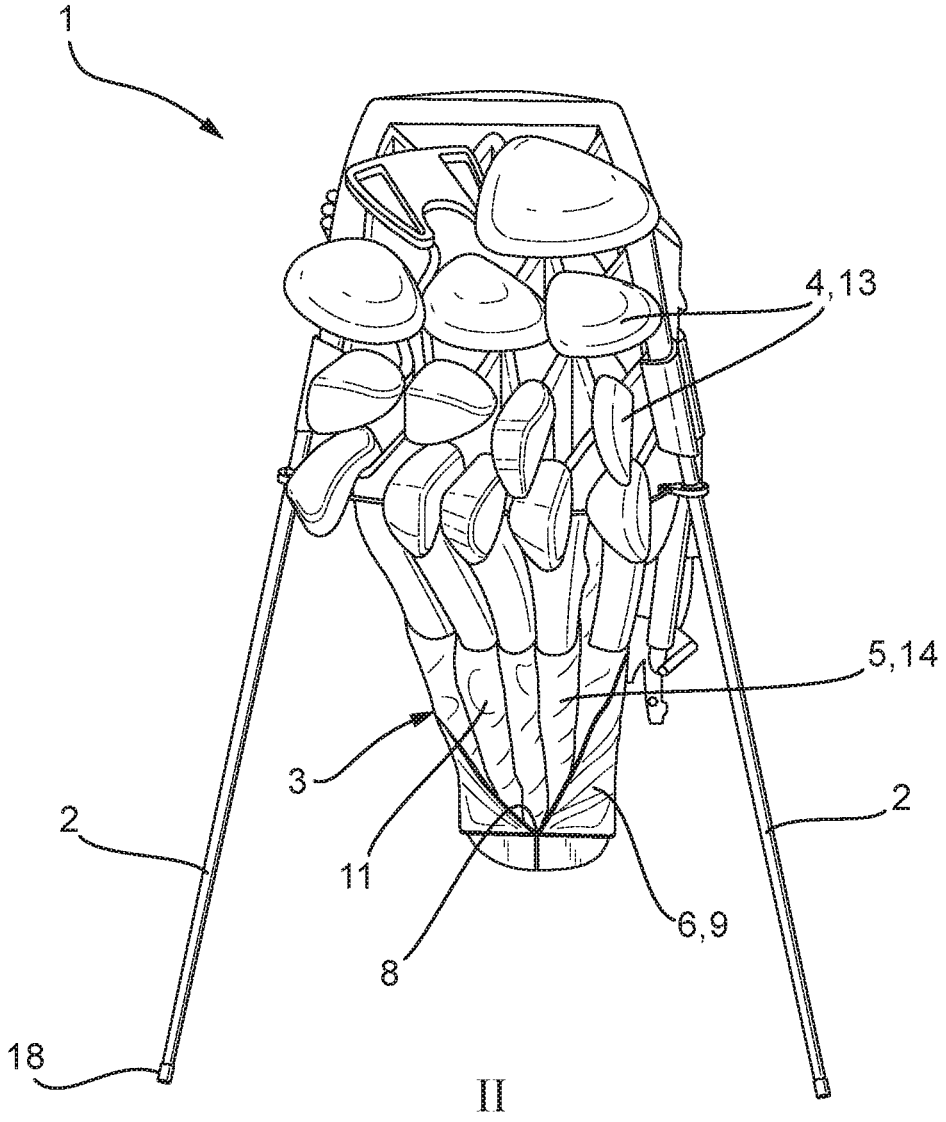
FIG. 1 shows a schematic perspective front view of a golf bag with golf clubs in folded-out position.

It is noted that the figures are only schematic representations of a preferred embodiment of the invention, and that these are given by way of non-limiting exemplary embodiment only.

In the figures, a golf bag 1 is shown, comprising a club holder 3, provided with supporting legs 2, for receiving golf clubs 4. The golf bag 1 is adjustable between a collapsed position I, shown in FIG. 4, in which the supporting legs 2 extend substantially along the club holder 3, and a folded-out position II, shown in FIGS. 1-3, in which the supporting legs 2 extend away from the club holder 3 and support the club holder 3 in an inclined position. The club holder 3 comprises a flexible pouch 5 for therein receiving golf clubs 4 by the shaft thereof.

Figure 6:
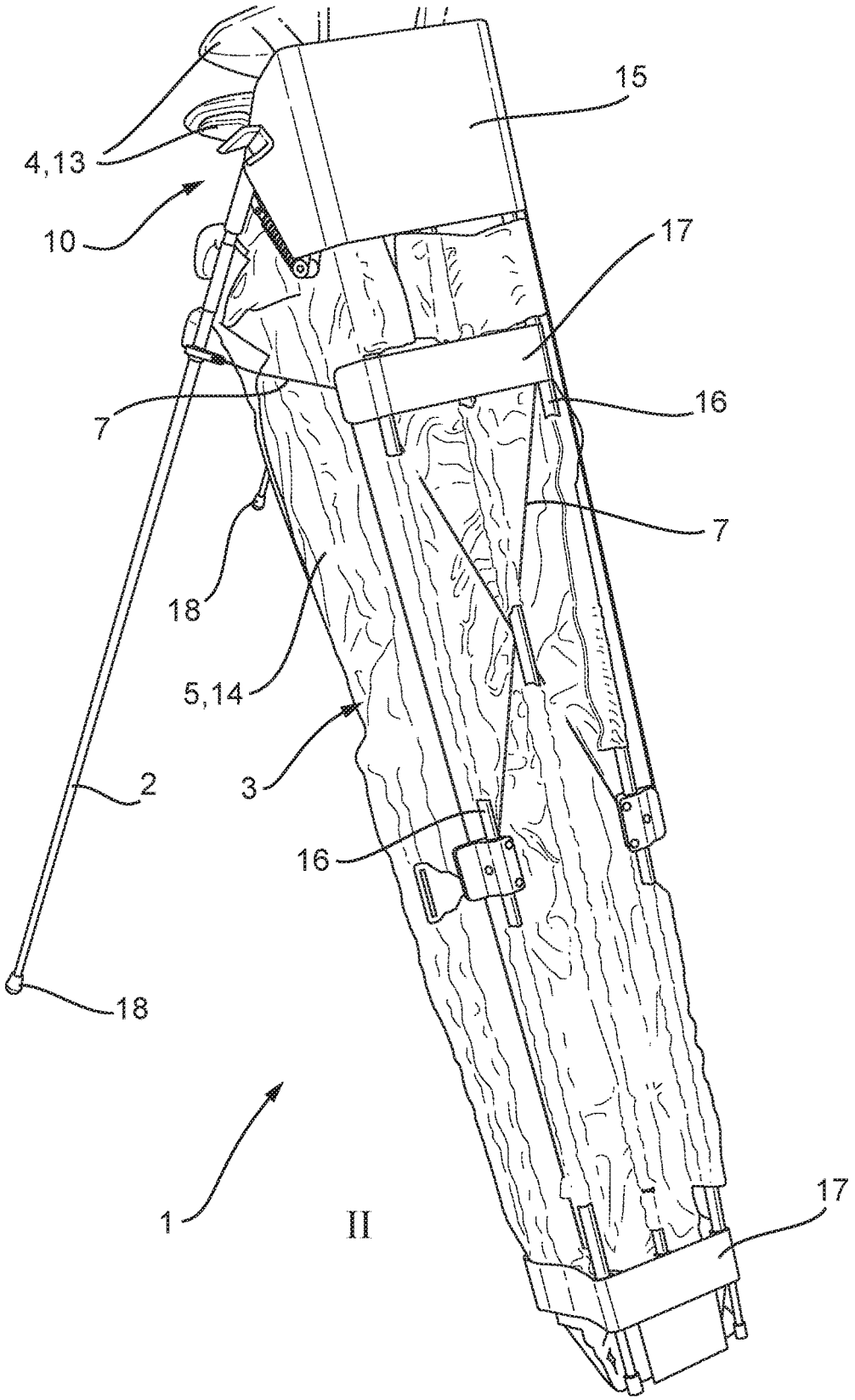
FIG. 6 shows a schematic perspective rear/side view of a golf bag in folded-out position as in FIG. 2, but without envelope.
Figure 7:
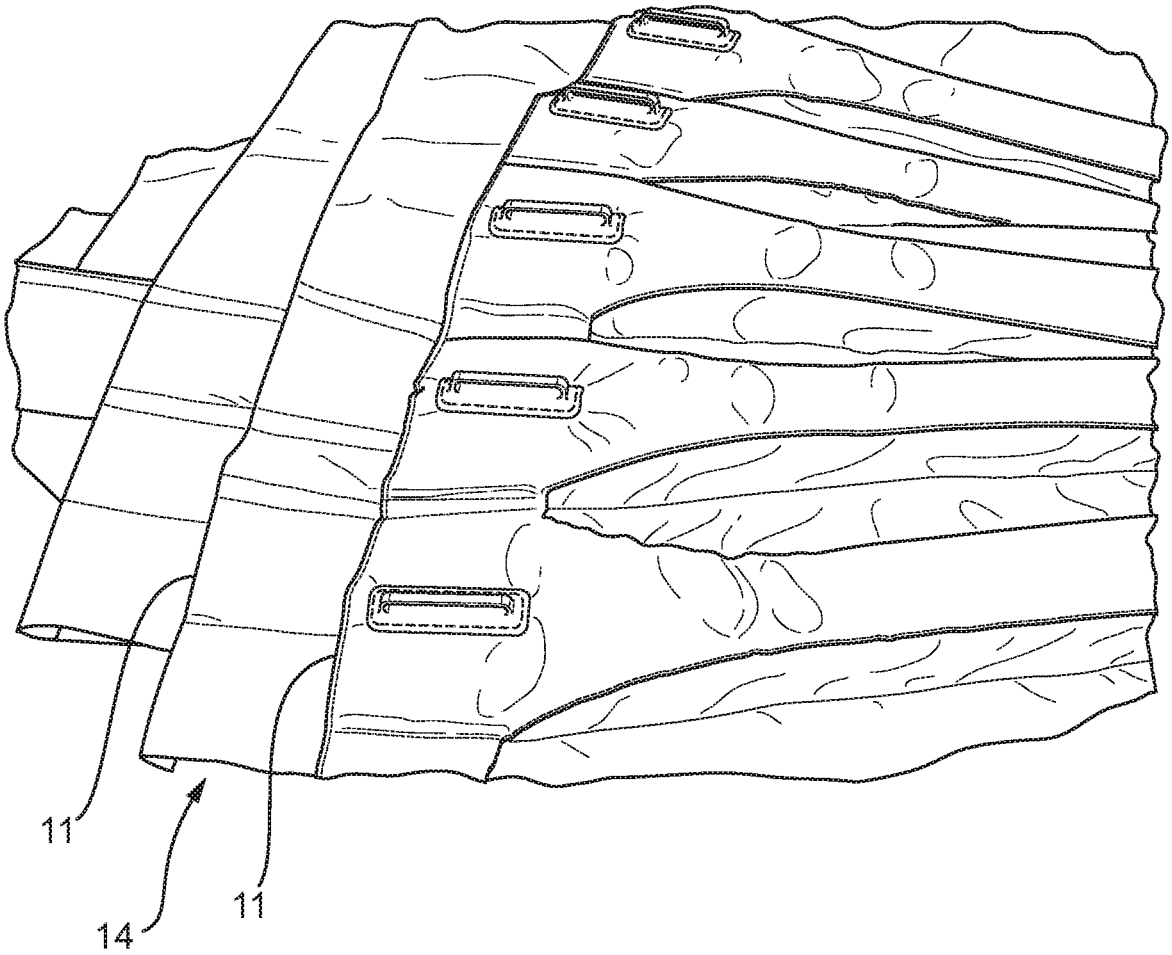
FIG. 7 shows a schematic perspective top plan view of a detail of a sack-shaped part of the golf bag of FIG. 6.

The pouch 5, as is well visible in FIGS. 6 and 7, is made for a considerable part from thin, flexible fabric. The pouch 5 is further provided with envelope 6 which is likewise made from thin flexible fabric. As can be seen well in FIG. 4, the pouch 5 in the collapsed position I lies flat because of its flexibility, and in the folded-out position II it hangs out—helped by the weight of the golf clubs 4 received in the pouch—under the influence of gravity.

Figure 2:
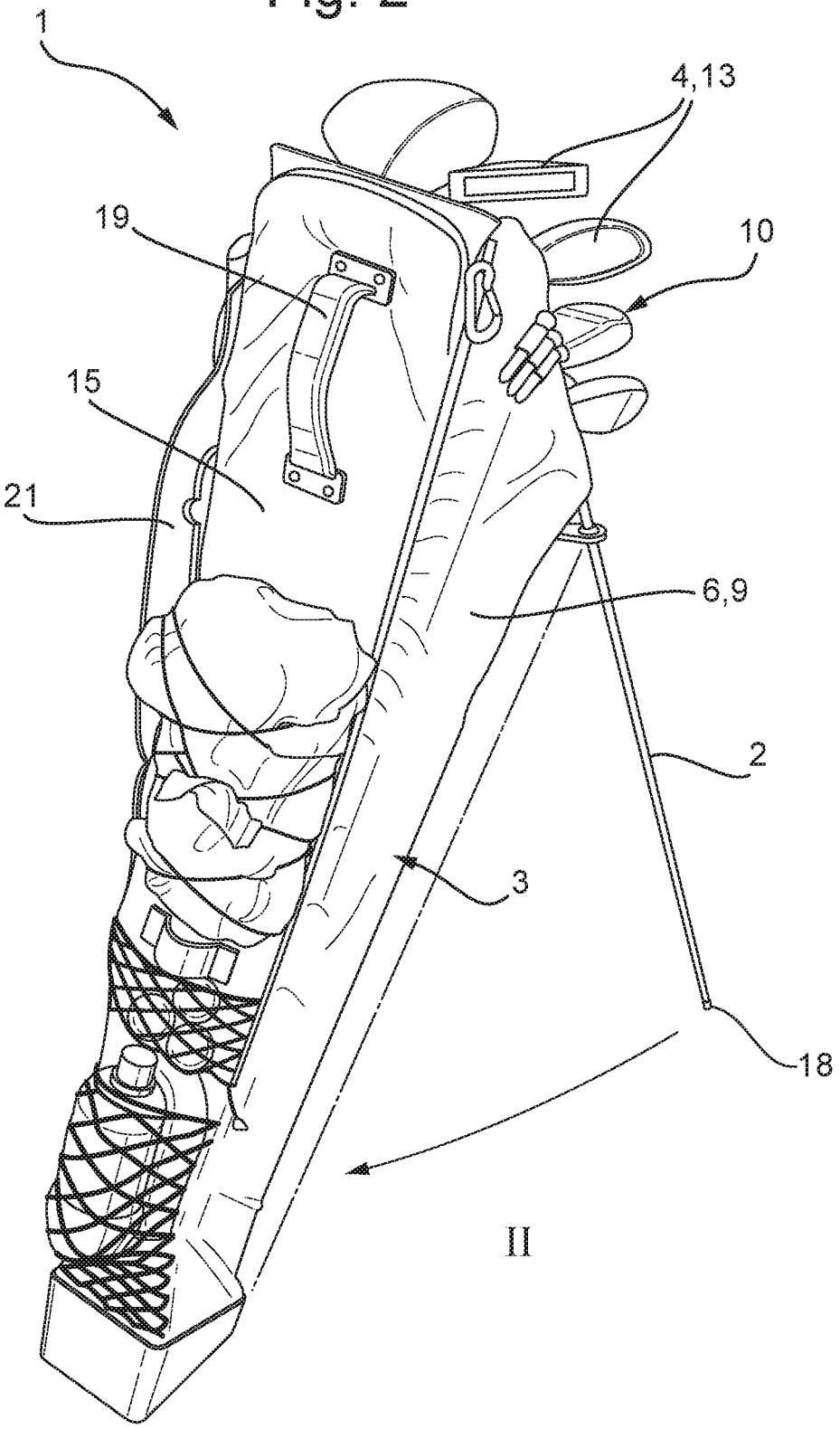
FIG. 2 shows a schematic perspective rear/side view of a golf bag with golf clubs in folded-out position.
Figure 3:
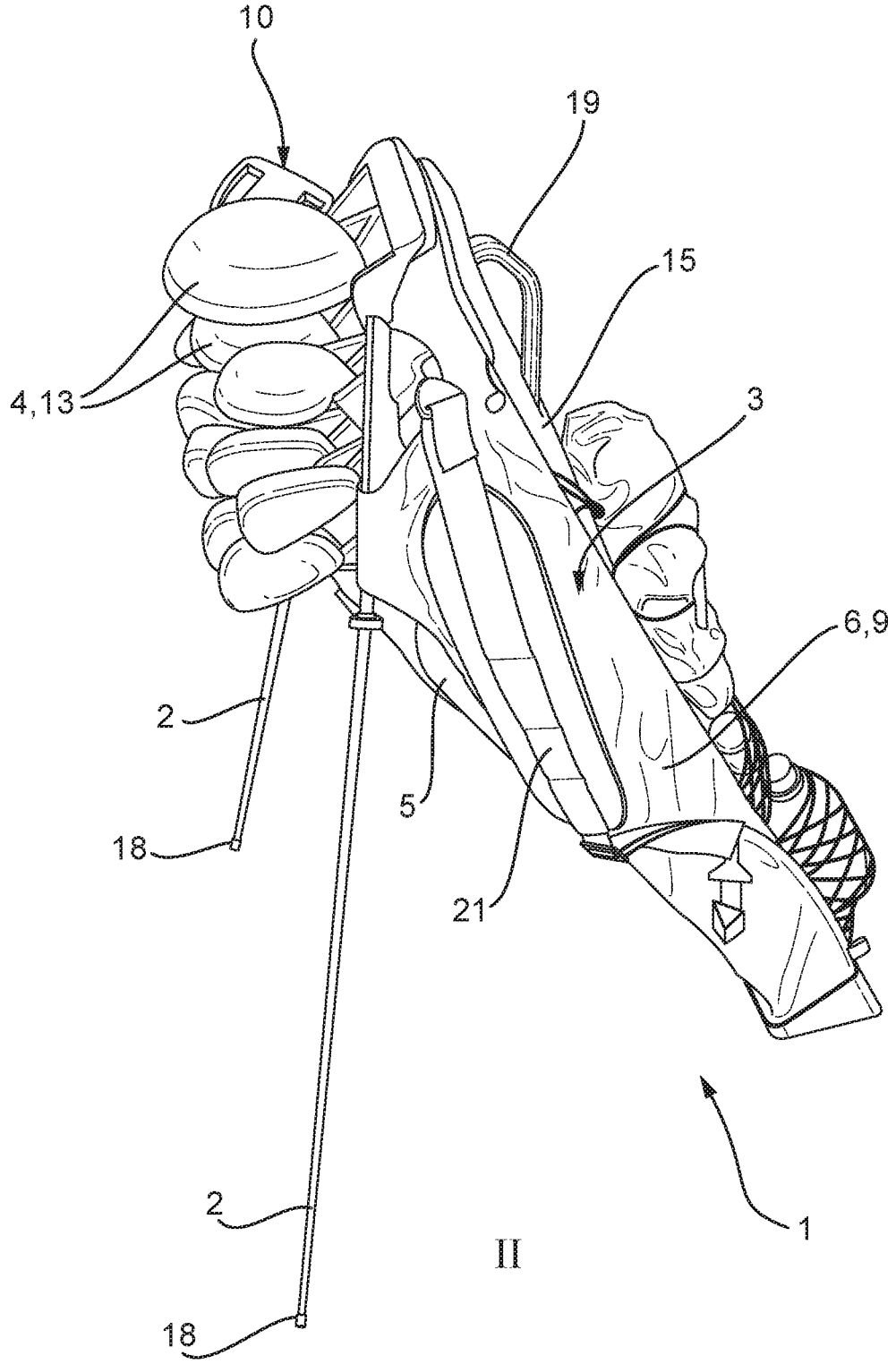
FIG. 3 shows a schematic perspective side view of a golf bag with golf clubs in folded-out position.
Figure 4:
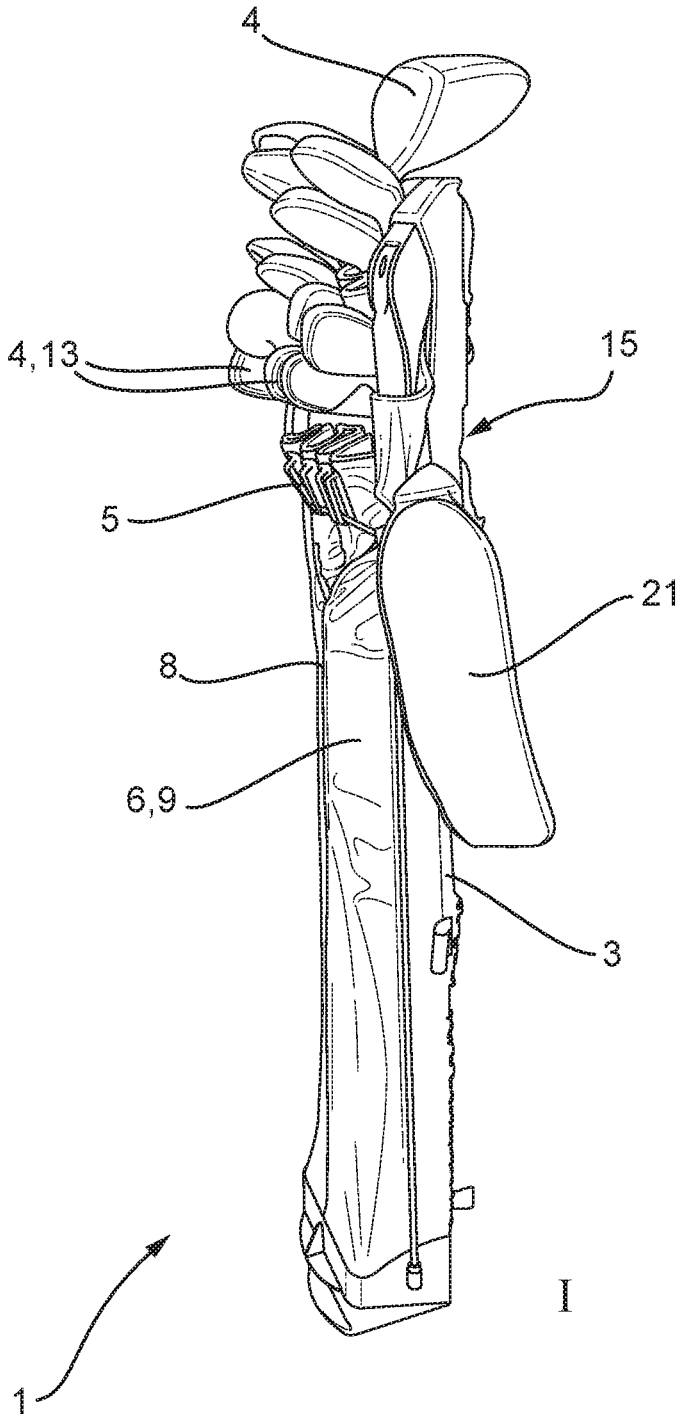
FIG. 4 shows a schematic perspective side view of a golf bag with golf clubs in collapsed position.
Figure 5:
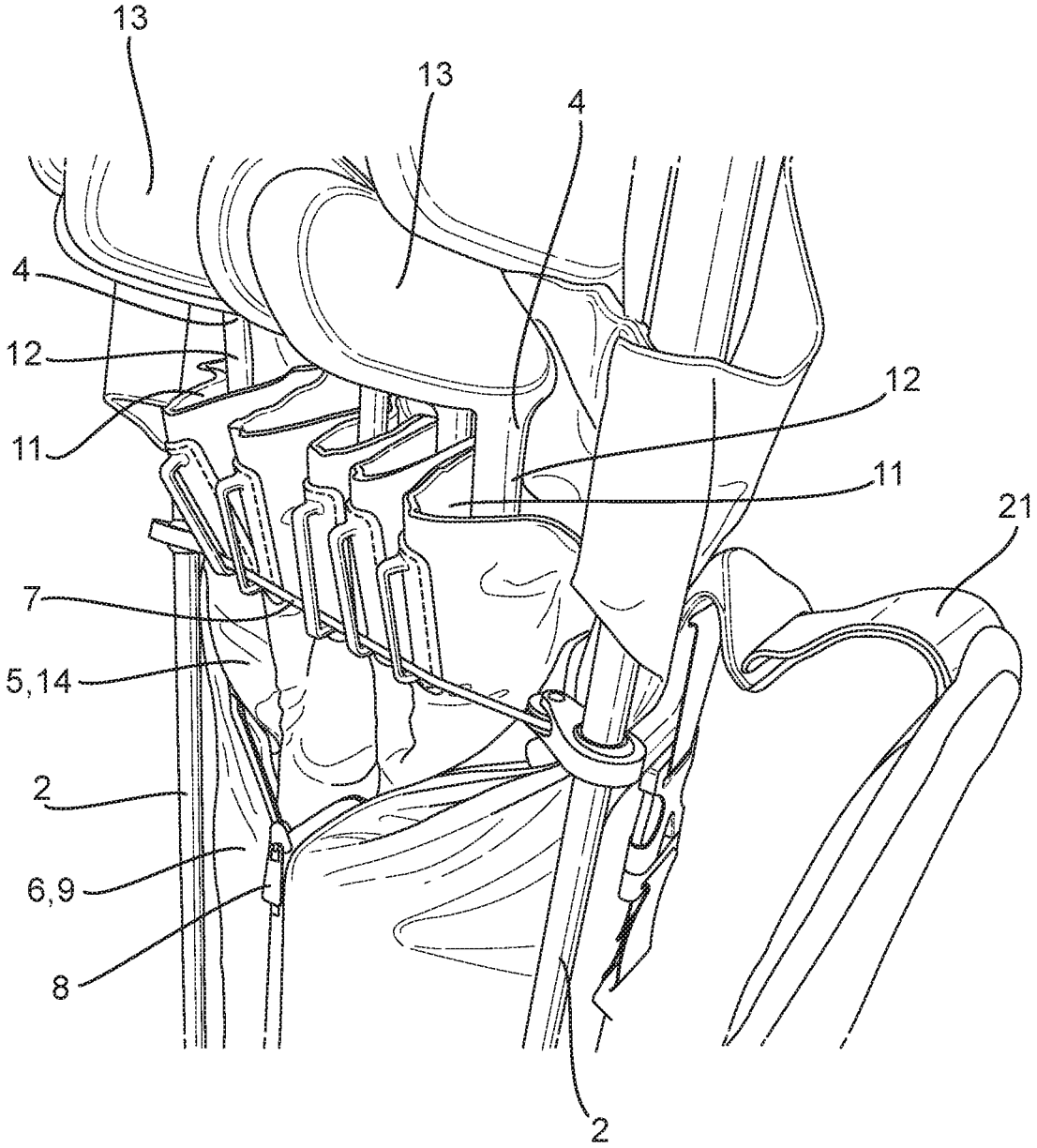
FIG. 5 shows a schematic perspective detailed view of the golf bag of FIG. 4.

The pouch 5 in the collapsed position I is constricted. Constriction has been carried out with the aid of a constricting provision, which is implemented with a cord 7 as a pull element. The constricting provision furthermore comprises the envelope 6, which in a closed position thereof in the collapsed position I snugly envelops the pouch and counteracts hanging-out of the pouch 5, and which in a release position releases the pouch 5 for it to hang out. The envelope 6 is implemented as an outer jacket 9 provided with a zipper 8. The outer jacket 9 in zipped-up condition as shown in FIGS. 4 and 5 in the closed position envelops the pouch 5 tightly, and—as shown in FIGS. 1-3—after unzipping releases the pouch 5 for it to hang out. The outer jacket 9 may alternatively be elastic, being made, for example, from elastic material that in the collapsed position snugly envelops the pouch and/or the club holder, and that stretches upon the pouch 5 fanning out.

As can be seen well in FIG. 1, the supporting legs 2 in the folded-out position II set up a top of the flexible pouch 5 in a presentation plane 10, so that the pouch 5 in the folded-out position II is well accessible for inserting and taking out the golf clubs 4. Terminating in the presentation plane 10 are shaft receptacles 11 which, with mutual spacing, are grouped in rows. The rows run along each other with an intermediate distance. As a result, golf clubs 4 whose shaft 12 has been received in a shaft receptacle 11 thus have their heads 13 positioned on the presentation plane 10 in a conveniently arranged manner in rows spaced apart with an intermediate distance. The shaft receptacles 11—as can be seen well in FIG. 7—are here implemented as compartments of a flexible, sack-shaped part 14 which forms the pouch 5. The shaft receptacles 11 may, if desired, have different lengths, and may possibly be length-adjustable at their lower ends, so that the heads 13 of the golf clubs per row end up at the same height, and between the rows in collapsed position I there is sufficient distance to receive the heads 13 substantially in one plane. In FIG. 4 it is well visible that the heads 13 are substantially in one plane.

The club holder 3 comprises a substantially stiff back part 15, and carries the flexible, sack-shaped part 14 which forms the pouch 5 here. In the collapsed position I the sack-shaped part 14 is fixedly constricted onto the back part 15 with the aid of the cord 7. This can also be seen well in FIG. 4. In the folded-out position II the sack-shaped part 14 is hanging from back part 15, fanning out, so that the pouch 5 in the folded-out position II, adjacent a top of the golf bag 1, has a relatively large and well accessible presentation plane 10 for the golf clubs 4. The pouch 5 then forms a tube narrowing down from a wide top, in the form of a wedge. Fanning out—as will be further elucidated hereinafter—here takes place upon folding out, as a result of the force of gravity that is exerted on the golf clubs 4.

The back part 15 forms a supporting face which is trough-shaped adjacent the top, so that the heads 13 of the golf clubs 4 are well protected in the collapsed position I. The supporting face, as can be seen well in FIGS. 6-8, is built up from tubes 16 extending in mutually spaced-apart relation, with stiff spacers 17 between them.

The sack-shaped part 14 forms a flexible front panel of the golf bag 1, and also forms a part of side panels of the golf bag. The sack-shaped part 14 is attached at a bottom of the back part 15, and is pivotable due to the flexibility of the material of the sack-shaped part.

The combination of the back part made up of tubes and the flexible sack part leads to a particularly light and cost-effective construction.

Figure 8:
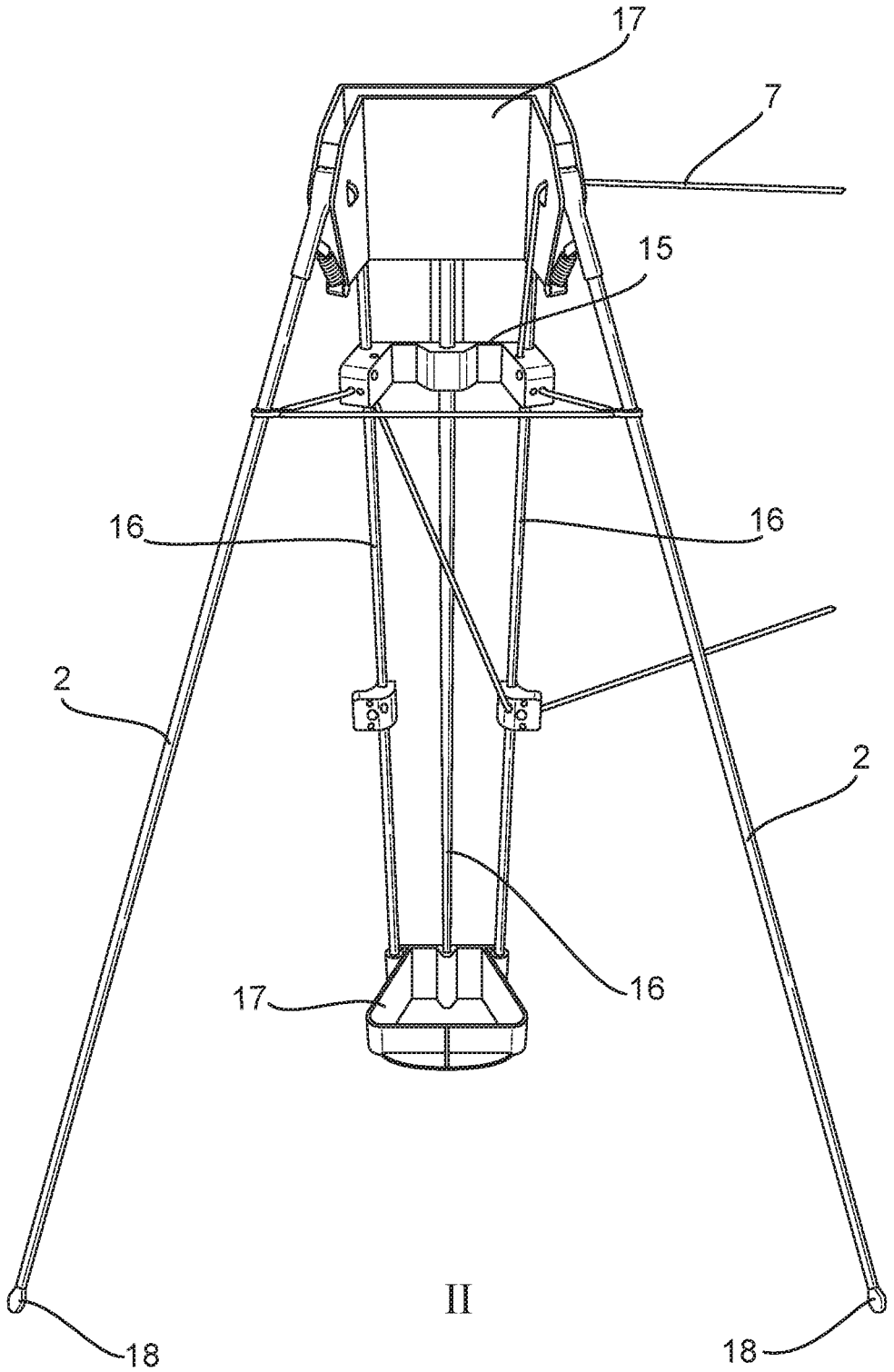
FIG. 8 shows a schematic perspective front view of a back part with legs of a golf bag in folded-out position as in FIG. 2, that is, without sack-shaped part and without envelope.
Figure 9:
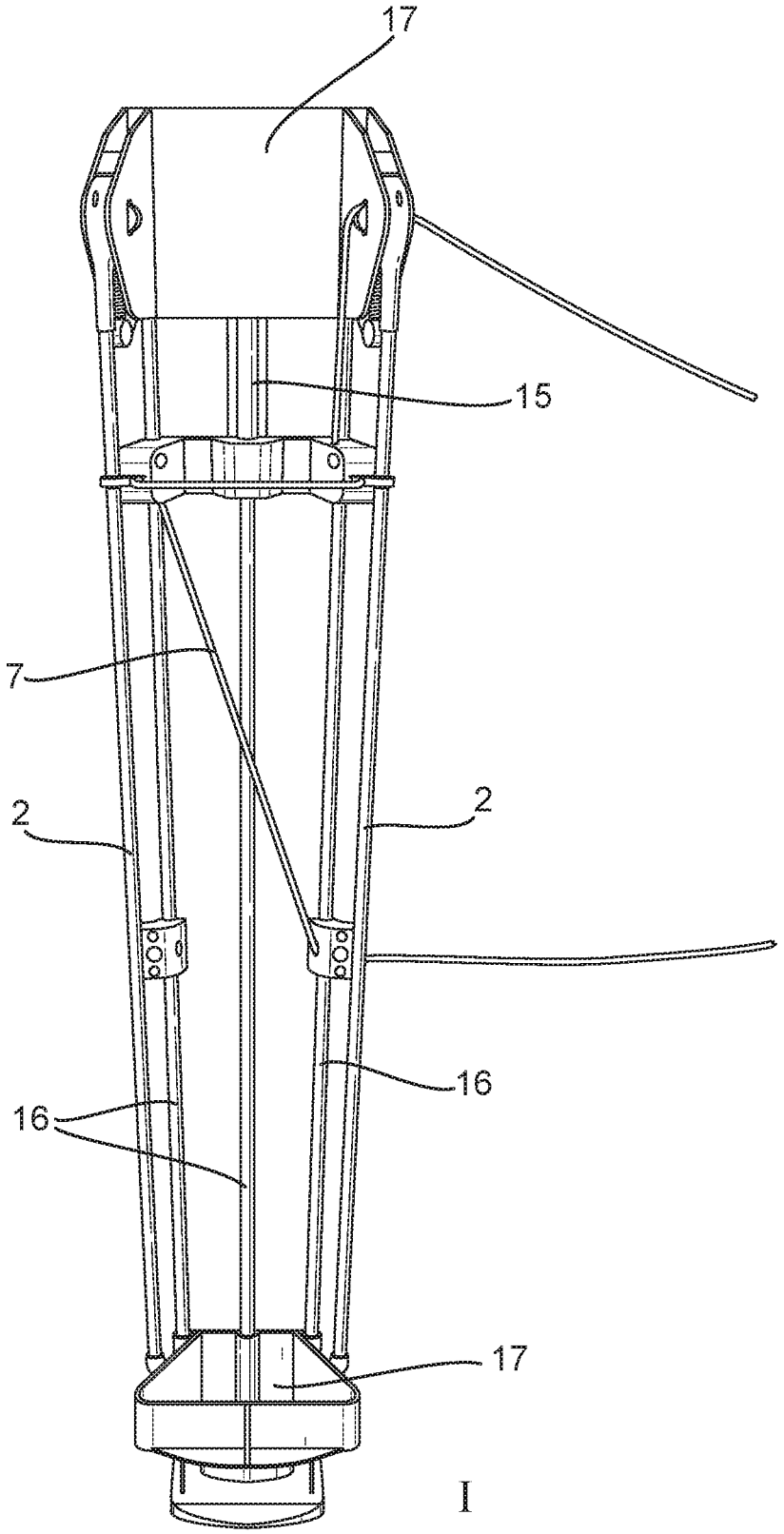
FIG. 9 shows a schematic perspective front view of the back part with legs of FIG. 8 in collapsed position.

It can be seen well in FIGS. 8 and 9 that the supporting legs 2 are pivotably arranged adjacent a top of the back part 15. In the collapsed position I the supporting legs 2 extend along the back part 15, with free ends 18 directed towards the bottom of the golf bag. In the folded-out position II they run away from the back part 15, and are located at a distance from the bottom of the back part 15. The supporting legs 2 are connected with the back part 15 through springs, so that they are under a bias which energizes the legs 2 towards the folded-out position. The supporting legs 2 are further attached to the pouch 5. In the folded-out position II the supporting legs pull a free edge of the pouch taut, so that the pouch opening is held open and the presentation plane 10 is pulled taut.

In FIGS. 8 and 9 it is further shown that a pull element implemented as a cord 7 is provided, with which the golf bag 1 is adjustable from the folded-out position II, to the collapsed position I. With the aid of pulleys, the cord 7 is guided in a loop along the supporting legs 2 and the tubes 16 of the back part 15. The cord 7 is coupled with the shoulder strap 21, shown in FIG. 3, so that the golf bag 1, when being lifted and taken onto the shoulder, can be returned, against gravity, to the collapsed position I. The cord 7 works against the bias provided by the springs, so that the golf bag 1, when upon being set down it does not hang from the cord 7 anymore, can fold out again under the weight of the golf clubs 4 and the spring action.

The cord 7 has further been guided along a free edge of the pouch, so that the cord, as the pull element, can support the pouch in the folded-out position II, and can constrict it in the collapsed position I. In the collapsed position, the supporting legs, if so desired, may possibly be brought inside the jacket 9 via the zipper 8.

Thus the golf bag 1 can automatically fold out upon being put down, and automatically collapse upon being lifted. The back part 15 is provided at a top with a handle 19, which facilitates lifting of the bag and taking it on the shoulder by way of the shoulder strap 21. Once suspended from the shoulder, the golf bag 1 in a flat condition can be easily carried along under the arm.

Figure 10:
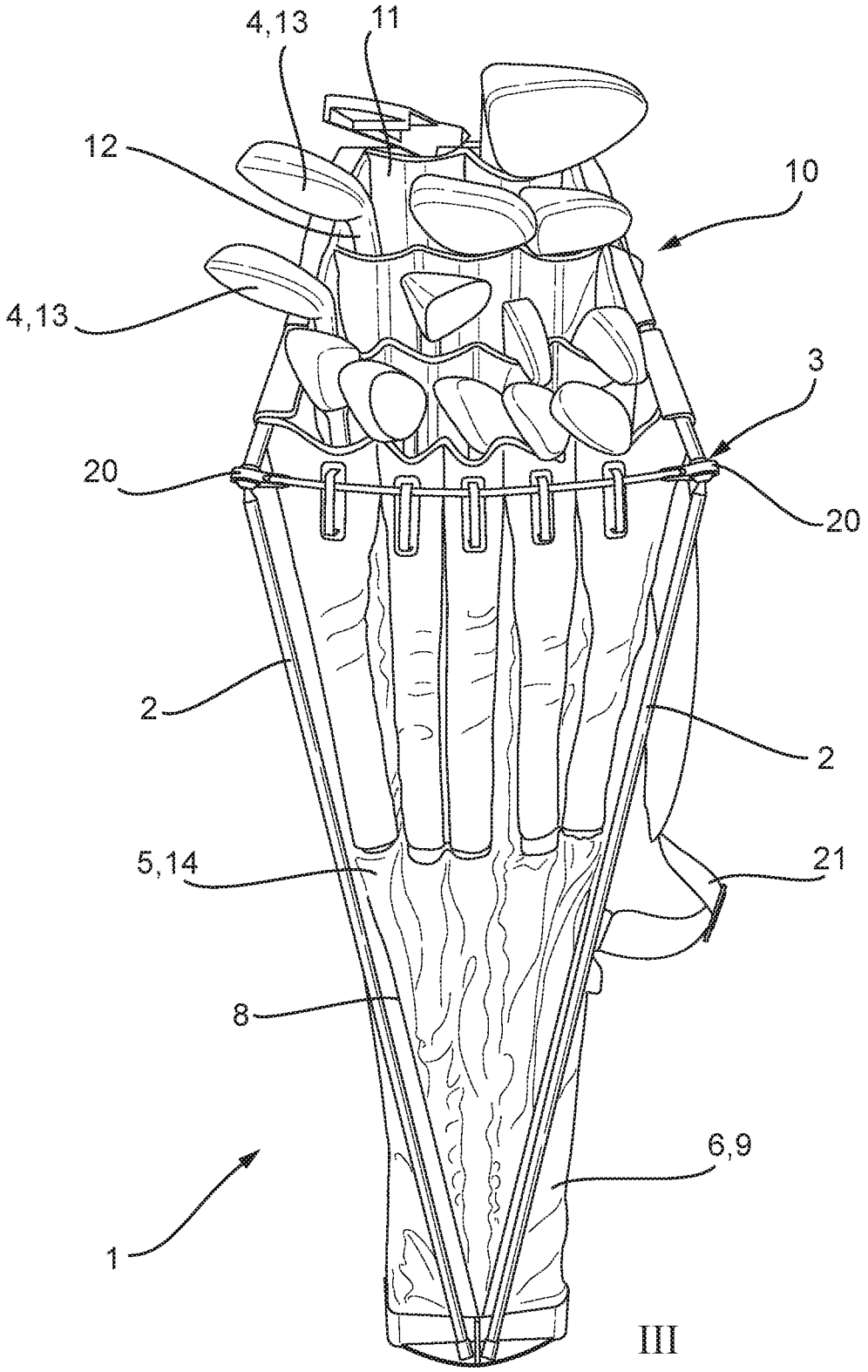
FIG. 10 shows a schematic perspective front view of a golf bag with golf clubs of FIG. 1 in a variant on the folded-out position, with the supporting legs, with the aid of hinges, brought in a configuration with their free ends near the bottom of the back part.

The supporting legs 2 are provided with hinges 20, with which the supporting legs 2, in a variant of the folded-out position III, can be brought into a configuration with their free ends located near the bottom of the back part 15. This is shown in FIG. 10. In this variant of the folded-out position, the golf bag 1 can, in folded-out condition, be coupled with a buggy or golf cart without the supporting legs 2 projecting and being in the way.

Possibly, the golf bag 1 may be further provided at the top thereof with a cap and/or hood, which protects the heads 13 of the golf clubs 4 during transport in collapsed position I and in the event of rain during play in the folded-out position II. Also, the bottom of the club holder 3 may be provided with a wheel or sliding element to facilitate small displacements in the folded-out position II.

The golf bag of the above-described example has a flexible front panel and a stiff back panel having therebetween at least one shaft receptacle for therein receiving a golf club by the shaft thereof, while front and back panel are connected with each other at a bottom of the golf bag, and are adjustable relative to each other between a collapsed, substantially flat position in which front and back panel run substantially along each other, and a folded-out, substantially wedge-shaped position in which front and back panel diverge and in which between their free ends a presentation plane is located in which the shaft receptacle terminates.

The invention is not limited to the exemplary embodiment discussed here. Many implementation variants are possible. Thus, instead of fabric, a foil (film) may be used. Also, the club holder, in particular the pouch, may receive the shafts of the golf clubs without separate shaft receptacles.

These and other variations will be clear to those skilled in the art and are within the scope of the invention as set forth in the appended claims.

The invention claimed is:

1. A golf bag, comprising a club holder for receiving golf clubs having a head and a shaft extending from the head, the club holder being provided with supporting legs, which golf bag is adjustable between a collapsed position in which the supporting legs extend along the club holder, and a folded-out position in which the supporting legs extend away from the club holder and support the club holder in an inclined position, wherein the club holder comprises a flexible pouch forming a flexible front panel of the golf bag between the supporting legs for therein receiving golf clubs by the shaft thereof, wherein the supporting legs are attached to the flexible front panel of the flexible pouch, wherein in the folded-out position the supporting legs set up at a top of the flexible pouch a presentation plane provided with one or more insertion openings for receiving golf clubs by the shaft thereof, the one or more insertion openings being kept open by the supporting legs in the folded-out position, wherein the supporting legs, as the golf bag transitions from the collapsed position with a free edge of the top of the flexible front panel of the flexible pouch constricted, to the folded-out position, pull the free edge of the top of the flexible front panel of the flexible pouch taut between the supporting legs, so that the one or more insertion openings is kept open and the presentation plane is pulled taut.

2. The golf bag according to claim 1, wherein the pouch in folded-out position hangs out from a back part.

3. The golf bag according to claim 1, wherein the pouch in the collapsed position is constricted.

4. The golf bag according to claim 1, wherein the club holder comprises a planar stiff back part, and a flexible, sack-shaped part connected therewith.

5. The golf bag according to claim 4, wherein the sack-shaped part in the collapsed position is fixedly constricted onto the back part with the aid of a pull element.

6. The golf bag according to claim 4, wherein the sack-shaped part in the folded-out position hangs from the back part, fanning out.

7. The golf bag according to claim 4, wherein the back part forms a supporting face.

8. The golf bag according to claim 1, wherein a sack-shaped part of the flexible pouch forms the flexible front panel of the golf bag.

9. The golf bag according to claim 4, wherein the back part forms a stiff back panel.

10. The golf bag according to claim 1, wherein there is provided a pull element with which the golf bag is adjustable from the folded-out position to the collapsed position.

11. The golf bag according to claim 10, wherein the pull element is coupled with a shoulder strap attached to the bag.

12. The golf bag according to claim 10, wherein the pull element is coupled with the supporting legs to bring these, against a bias, to the collapsed position.

13. The golf bag according to claim 10, wherein the pull element is coupled with the free edge of the pouch to support it in the folded-out position, and to constrict it in the collapsed position.

14. The golf bag according to claim 4, wherein the supporting legs are pivotably arranged at a top of the back part and in the collapsed position extend along the back part with free ends directed towards the bottom of the golf bag, and in the folded-out position run away from the back part and are located at a distance from the bottom of the back part.

15. The golf bag according to claim 4, wherein the back part is provided at a top thereof with a handle.

* * * * *